US008593361B2

(12) United States Patent
Robert et al.

(10) Patent No.: US 8,593,361 B2
(45) Date of Patent: Nov. 26, 2013

(54) MULTI-SECTOR RADIATING DEVICE WITH AN OMNI-DIRECTIONAL MODE

(75) Inventors: Jean-Luc Robert, Betton (FR); Philippe Minard, Saint Medard sur Ille (FR); Ali Louzir, Rennes (FR)

(73) Assignee: Thomson Licensing, Issy les Moulineaux (FR)

( * ) Notice: Subject to any disclaimer, the term of this patent is extended or adjusted under 35 U.S.C. 154(b) by 305 days.

(21) Appl. No.: 12/734,935

(22) PCT Filed: Nov. 19, 2008

(86) PCT No.: PCT/EP2008/065865

§ 371 (c)(1),
(2), (4) Date: Jun. 3, 2010

(87) PCT Pub. No.: WO2009/080418

PCT Pub. Date: Jul. 2, 2009

(65) Prior Publication Data

US 2010/0245207 A1 Sep. 30, 2010

(30) Foreign Application Priority Data

Dec. 21, 2007 (FR) ..... 07 60276

(51) Int. Cl.
*H01Q 13/10* (2006.01)

(52) U.S. Cl.
USPC ..... 343/770; 343/767; 343/876

(58) Field of Classification Search
USPC ..... 343/767, 770, 893, 700 MS, 876
See application file for complete search history.

(56) References Cited

U.S. PATENT DOCUMENTS 5,187,489 A * 2/1993 Whelan et al. ..... 343/767
5,835,063 A 11/1998 Brachat et al.
6,518,931 B1 * 2/2003 Sievenpiper ..... 343/770
2002/0003505 A1 * 1/2002 Ebling et al. ..... 343/911 R
2002/0180655 A1 12/2002 Mohuchy et al.
2008/0303732 A1 * 12/2008 Lai et al. ..... 343/770

FOREIGN PATENT DOCUMENTS

| | | | |
|---|---|---|---|
| EP | 0685901 | 12/1995 | |
| EP | 1263085 | 12/2002 | |
| EP | 1291969 | 3/2003 | |
| EP | 1617513 | 1/2006 | |
| EP | 1617513 A1 * | 1/2006 | ..... H01Q 3/34 |
| EP | 16117513 A1 * | 1/2006 | ..... H01Q 9/04 |
| WO | WO 02/47205 | 6/2002 | |
| WO | WO03098732 | 11/2003 | |
| WO | WO2005011057 | 2/2005 | |
| WO | WO2006070017 | 7/2006 | |

OTHER PUBLICATIONS

Search Rept:Apr. 6, 2009.
Search Rept:Jul. 10, 2008.

* cited by examiner

*Primary Examiner* — Douglas W Owens
*Assistant Examiner* — Collin Dawkins
(74) *Attorney, Agent, or Firm* — Tutunjian & Bitetto, P.C.

(57) ABSTRACT

The present invention relates to a multi-sector radiating device intended to receive and/or transmit electromagnetic signals, comprising at least, arranged on a plane substrate:

Figure 5:
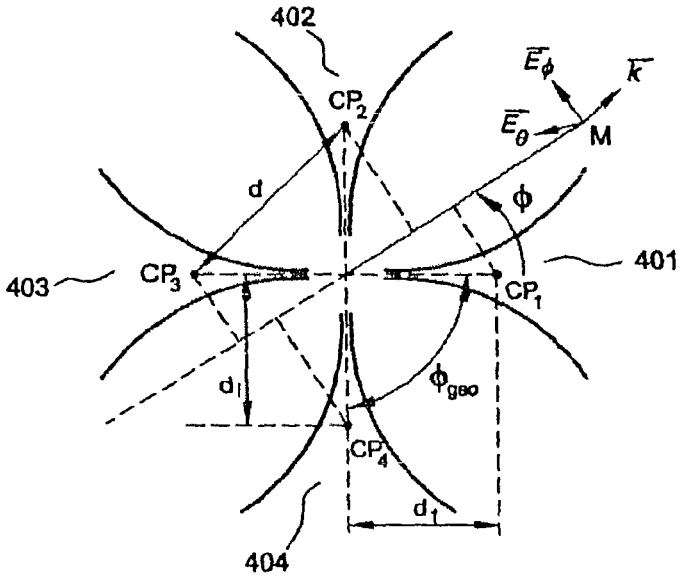
FIG.5 (Prior Art)

a first set of antennas, with:

a first antenna, a second antenna, a third antenna, arranged in the opposite manner to the first antenna, a fourth antenna, arranged in the opposite manner to the second antenna, the antennas being longitudinal radiation slot type antennas, said antennas each presenting a bisector, wherein the radiating device comprises a switching circuit capable of activating one or more of the antennas, and notably all the antennas of the first set of antennas, -and in that the bisectors of the opposed antennas on the substrate are not combined.

7 Claims, 4 Drawing Sheets

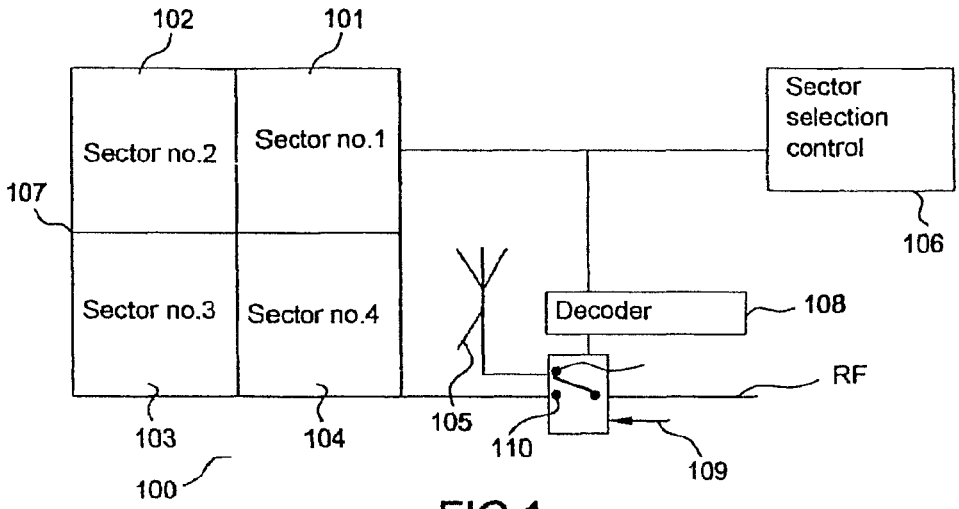
FIG.1
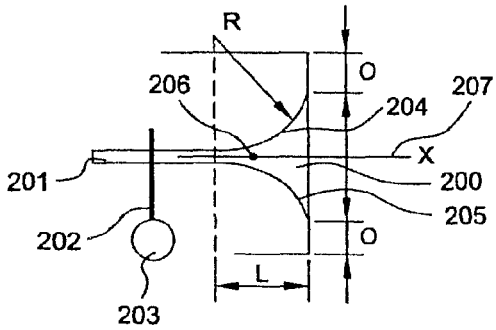
FIG.2 *(Prior Art)*
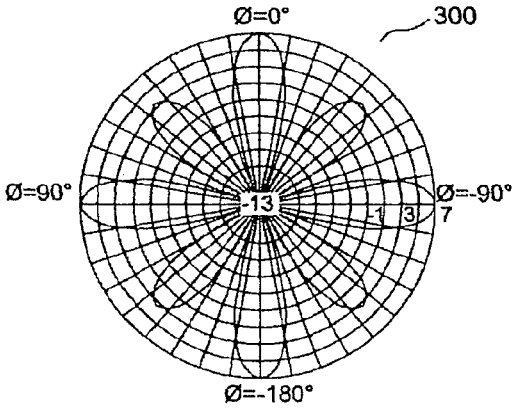
FIG.3
*(Prior Art)*
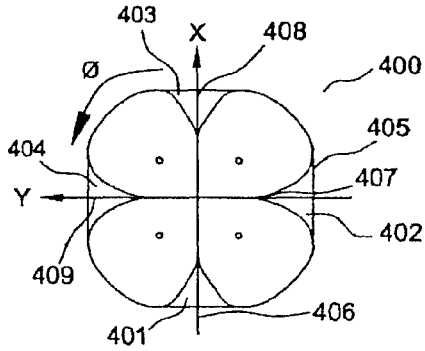
FIG.4
*(Prior Art)*

MULTI-SECTOR RADIATING DEVICE WITH AN OMNI-DIRECTIONAL MODE

This application claims the benefit, under 35 U.S.C. §365 of International Application PCT/EP2008/065865, filed Nov. 19, 2008, which was published in accordance with PCT Article 21(2) on Jul. 2, 2009 in English and which claims the benefit of French patent application No. 0760276, filed Dec. 21, 2007.

TECHNICAL FIELD OF THE INVENTION

The purpose of the present invention is a planar multi-sector radiating device with an omni-directional mode. The radiating device according to the invention proposes, in a general manner, a first operating mode, in which one or more directive antennas of the radiating device considered can be selected, and a second operating mode in which the radiating device complies with the characteristics of an omni-directional antenna.

The domain of the invention is that of multi-sector antennas or multiple antenna systems, a domain whose expansion is today very great. The multi-sector antennas are used notably in MiMo (Multiple Input Multiple Output) type devices of standards 802.11 or 802.16, which particularly enable improvement of the efficiency of antennas considered by maximising the capacity of the transmission channel.

The multi-sector radiating devices, also called multi-sector antennas, are particularly used in communication networks known as mobile networks. Such networks are defined by a group of nodes, called mobile nodes, connected together via a wireless medium. These nodes can freely and dynamically organise themselves and thus create an arbitrary and temporary topology of the network, from which the designation of the network that they constitute by the expression "mobile network", thus enabling persons and terminals to interconnect in zones that do not posses predefined communications infrastructure. The multi-sector radiating devices can also be used in a new type of network, from the mobile network concept, known as meshed networks. The meshed networks are constituted by a set of fixed nodes and mobile nodes that are interconnected via wireless links.

Numerous studies are currently being undertaken to improve the capacity, particularly in terms of bitrate, of meshed networks by alternatives using known concepts such as the use of multiple RF Radio channels, MiMo techniques or antennas known as Beamforming antennas.

The multiple RF channels technique enables increasing the network capacity by using independent fadings at different frequencies and the orthogonality of frequencies. Similarly the multiple antenna systems, both in transmission and reception (MiMo techniques), improve the capacity and integrity of the wireless link by use of the diversity of antennas and spatial multiplexing.

Such diversity provides the receptor with several replies, which are more or less independent, of the signal transmitted, it is an efficient technique to resolve problems of interfacing and fading, nonetheless when the interfaces are of a heightened level and from multiple access points, as is the case on a meshed network, such a diversity alone, does not suffice to improve the signal.

To respond to these insufficiencies, smart antennas or adaptive arrays are used. They enable the radiation efficiency to be improved and offer a good rejection rate of interferences. The essential principle of these antennas resides in the use of beamforming transmission-reception antennas, such beams enabling an effective radiation pattern to be obtained:

strong gain in the direction of the signal received, or transmitted, low gain in all other directions.

Hence directional transmission control may suffice to ensure a high bitrate transmission with a high degree of spatial reuse.

Such a solution, specifically adapted for the optimisation of a meshed network, nevertheless needs, for a radiating device considered, to have an omni-directional mode. By omni-directional mode, is designated in the present document a considered radiating device state in which said radiating device is capable of receiving, or transmitting, signals from or towards any direction at least in the azimuthal plane corresponding to the plane of the substrate supporting the considered radiating device. Such a state is used, notably during an initialisation phase linked to the introduction of a new node in the meshed network. In fact, such a new node given form by an item of equipment comprising the considered radiating device, must determine the state of the meshed network, the use of omni-directional mode responds to this requirement. The omni-directional mode can also be used in a current use phase, without the introduction of a new node in the meshed network taking place, to ensure for example the transmission of information (or broadcast) to the set of the network's other accessible nodes.

Thus, without increasing the complexity, the cost and the losses of a solution based on directive antennas, also called sectored antennas, the considered radiating device must be capable, when all sectors are active, of proposing the most omni-directional pattern possible.

One solution to responds to these requirements could consist in, as shown in FIG. 1, the use of a system 100 comprising notably a multi-sector radiating device 107 to which an omni-directional antenna 105 is added. In the example shown, the multi-sector radiating device 107 is comprised of a first directive antenna 101, dedicated to a first sector, a second directive antenna 102, dedicated to a second sector, a third directive antenna 103, dedicated to a third sector, and a fourth directive antenna 104, dedicated to a fourth sector. The selection of one or another of the directive antennas, or possibly the simultaneous selection of more than one directive antennas, is carried out by means of a sectors selection control device 106.

A switch 109 of "RF switch" type enables passing from directive mode 110, in which at least one of the directive antennas is activated, to an omni-directional mode 111, in which the omni-directional antenna 105 is activated.

Moreover, in the example shown, the system 100 comprises a decoder 108 for which a function is to detect, by interpreting a signal from the sector selection control device 106, if all the directive antennas of the multi-sector radiating device 107 are selected by said device 106. In the affirmative, the decoder provokes the mode state change of the system 100, causing it to pass from directive mode 110 to omni-directional mode 111 by acting on the switch 109.

However, a certain number of problems are associated with the solution shown in FIG. 1: first, the simple presence of the switch 109 leads to losses of signal strength of signals that pass through it, losses in the neighbourhood of 1 dB, this loss is due to the architecture of the switch 109. Then the presence of the decoder 108 causes extra cost in the manufacturing of such a system. Finally, the presence of the omni-directional antenna 105 also adds a cost to the implementation of such a system, and, according to its position in said system, necessarily interferes with one or other of the directive antennas, which themselves interfere with the operation of the omni-directional antenna.

The present invention proposes a solution to the problems and inconveniencies that have just been set out. In the invention, a solution is proposed to obtain a multi-sector radiating device with an omni-directional mode, a device that enables the formation of an omni-directional radiation pattern to be obtained, in at least one azimuthal plane, from a network of directive antennas. For this purpose, in the invention, the use is proposed on a given substrate of a plurality of longitudinal radiation directive antennas of tapered slot antenna type or Yagi antenna type as described for example, in the patent application WO02/47205 in the name of THOMSON Licensing S.A. or in the patent application WO2005/011057 in the name of STICHTING ASTRON, and to arrange these antennas in a particular way on the substrate in a manner to obtain the desired radiation pattern. The particular arrangement is obtained by adapting the relative position and/or certain parameters of the considered directive antennas. Advantageously, in order to increase the global capacity of the network in which the antennas will be used according to the invention, a multi-sector radiating device is proposed operating at a first frequency, enabling to insure an omni-directional mode without use of the specific radiating element for this mode, said radiating device integrating in itself at least a second system of antennas operating at a second frequency. The multiple frequency band multi-sector radiating device presents similar radiating characteristics, in terms of beam aperture, of gain per beam or again in the number of sectors, in the frequency bands considered.

The invention relates then essentially to a planar multi-sector radiating device intended to receive and/or transmit electromagnetic signals, comprising at least, arrange on a plane substrate supporting a conductive material, a first set of antennas with:

- a first antenna,
- a second antenna,
- a third antenna, arranged on the substrate plane in the opposite manner to the first antenna,
- a fourth antenna, arranged on the substrate plane in the opposite manner to the second antenna, the antennas being longitudinal radiation antennas, said antennas each present a bisector, characterized in that the radiating device comprises a switching circuit capable of activating one or more antennas of the first set of antennas, and in that the bisectors of opposed antennas on the substrate are noticeably in parallel and distant from one another, and in that the bisectors of two antennas arranged consecutively on the substrate are noticeably perpendicular.

The radiating device according to the invention can comprise one or more additional characteristics selected from among the following:

- the antennas are tapered slot antennas, a taper presenting a left profile and a right profile, the left profile and the right profile being dissymmetric,
- the left profile of one of the antennas of the first set of antennas presents one extremity forming a right angle with the right profile of the antenna consecutive to the considered antenna,
- the switching circuit is arranged at the level of a central part of the antenna network, the switching circuit being connected to the slot of each of the antennas by means of a connection line by an electromagnetic coupling, notably a Knorr type coupling,
- in the device according to the invention, each antenna of the network of slot antennas presents the following characteristics:
  - an operating wavelength LO,
  - a profile length L,
  - a width X of the tapered profile before the overflows,
  - a first overflow length O1, associated with a first tapered profile of the antenna,
  - a second overflow length O2, associated with a second tapered profile of the antenna,
  - an angle of rotation Alpha of the antenna,
  - a total width C of the tapered profile,
  - in this context, each antenna presents the following dimensioning:

$0.25LO<L<2.5LO$
$0.25LO<X<2.5LO$
$0.6LO<O1<1.5LO$
$0<O2<0.25LO$
$0 \text{ degree}<Alpha<20 \text{ degrees}$
$LO<C<2.5LO.$ each antenna presents the following dimensioning:

$L=0.7LO$
$X=LO$
$O1=0.75LO$
$O2=0.04LO$
$Alpha=5 \text{ degrees}$
$C=1.8LO.$

- the operating frequency of the first set of antennas is of the order of 2.4 GHz,
- the radiating device comprises at least a second set of longitudinal radiating antennas of tapered slot antenna type, the second set of antennas comprising four additional antennas, the slot of each of the additional antennas being set at profile level with a greater dimension than one of the antennas of the first set of antennas,
- the operating frequency of the second set of antennas is of the order of 5 GHz,
- the antennas are Yagi type antennas.

The different additional characteristics of the radiating device according to the invention, when they are not mutually exclusive, are combined according to all association possibilities to result in different embodiment examples of the invention.

The invention and its various applications will be better understood upon reading the description that follows and upon examination of the figures that accompany it.

Figure 6:
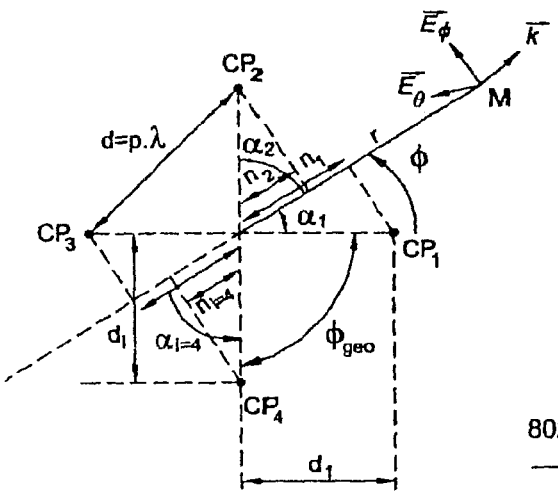
FIG.6 (Prior Art)
Figure 7:
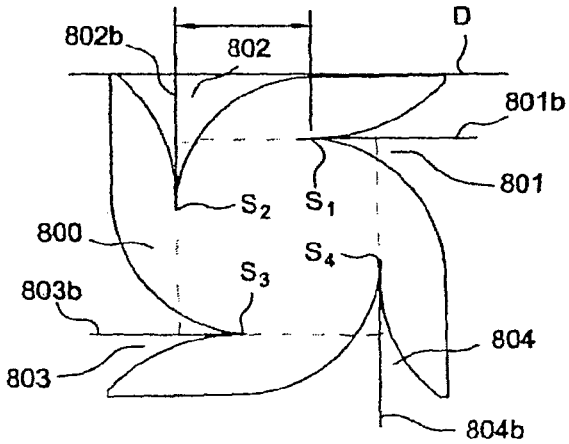
Figure 8:
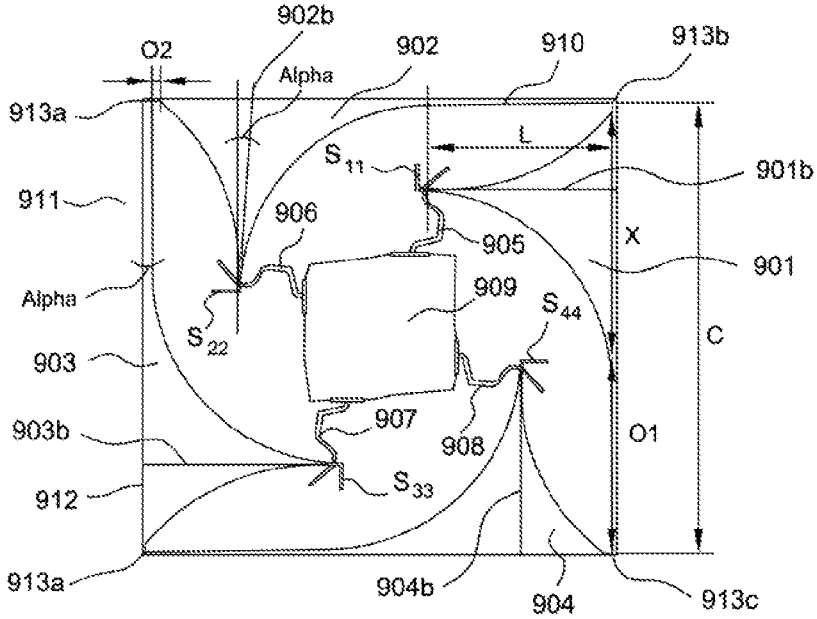
Figure 9:
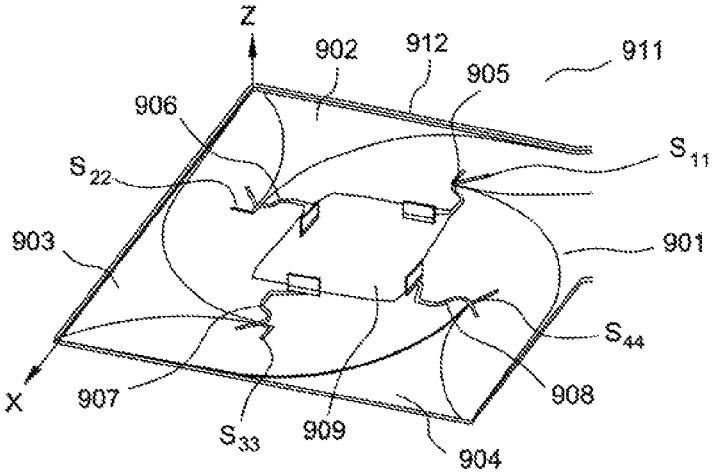
Figure 10:
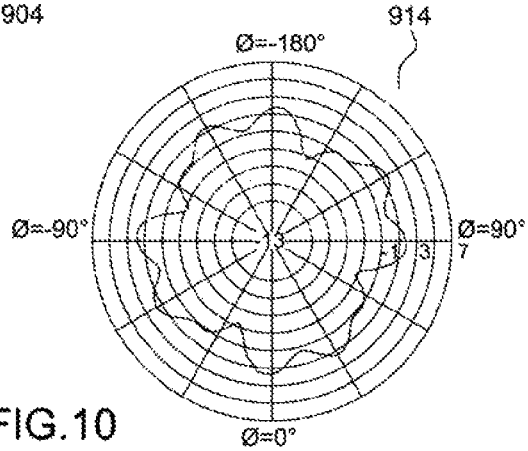
Figure 11:
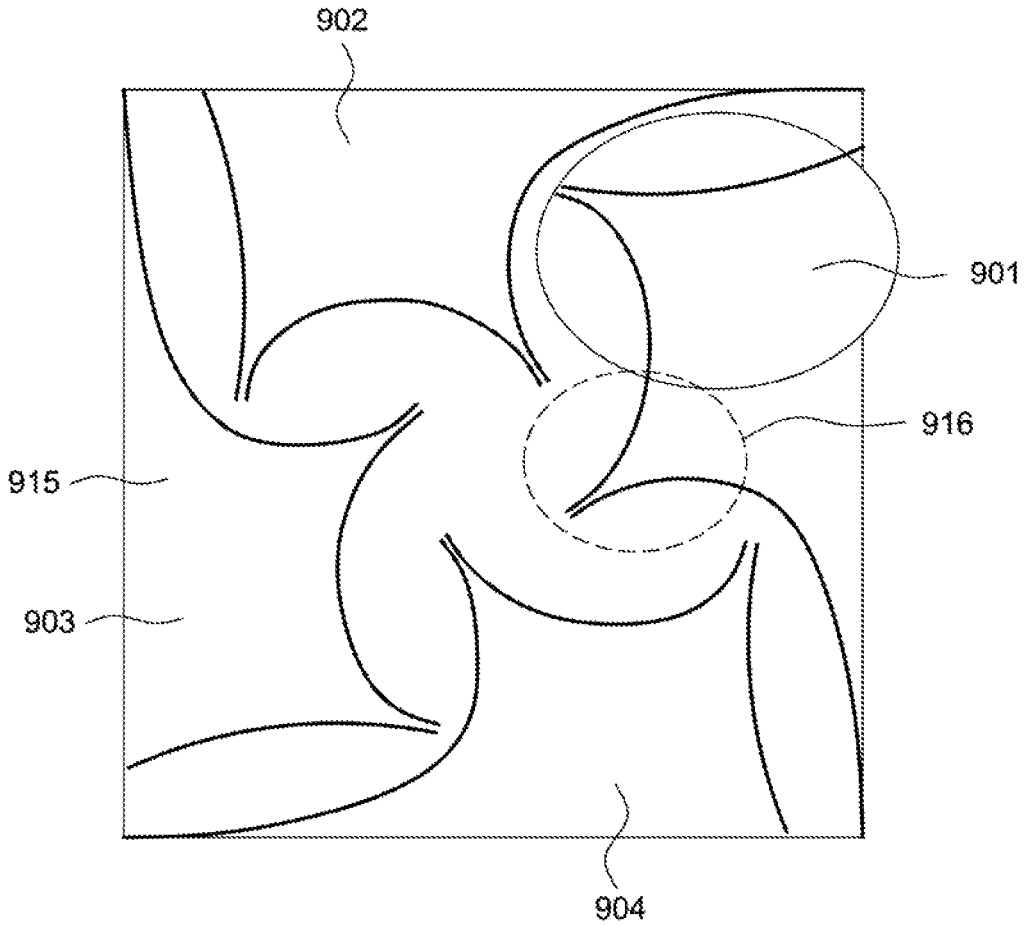

These are only provided as a non-restrictive example of the invention. The figures show:

in FIG. 1, already described, an example of the architecture of a system of sectored antennas with an omni-directional mode, according to the prior art, in FIG. 2, a diagrammatic representation of a Vivaldi type antenna, in FIG. 3, a radiation pattern obtained in an azimuthal plane with a network of antennas arranged in a standard manner, in FIG. 4, a diagrammatic representation of a network of antennas in a standard arrangement, in FIG. 5, a diagrammatic representation of a network of four Vivaldi type antennas, in FIG. 6, a diagrammatic representation of different geometric elements of the network of antennas of FIG. 5 intervening in the calculations resulting in the radiation pattern of said network of antennas, in FIG. 7, a diagrammatic representation of a first embodiment of the radiating device according to the invention, in FIG. 8, a first representation of a second embodiment of the radiating device according to the invention, in FIG. 9, a second representation of a second embodiment of the radiating device according to the invention, in FIG. 10, a radiation pattern, in an azimuthal plane, associated with the second embodiment, in FIG. 11, a third embodiment of the radiating device according to the invention, The various elements appearing on several figures maintain, unless otherwise specified, the same reference. The multi-sector radiating device according to the invention is based on the use of longitudinal radiating antennas of tapered slot antenna type, notably antennas of Vivaldi type, which constitute the means of reception and/or transmission of electromagnetic signals. Such antennas are mainly constituted by a tapered slot engraved in a metallized substrate. They enable simple integration into the various devices for which they are intended, and are characterized by their radiation in a substrate plane, said azimuthal plane. Other longitudinal radiating antennas such as Yagi antennas can also be used.

The dimensioning of a Vivaldi antenna is known by those skilled in the art. It can be implemented by acting on three main parameters, identifiable in FIG. 2, that are: —the dimensioning of an antenna 200, at the level of its Vivaldi type profile characterized by a slot 201 prolonged by a left profile 204 and a right profile 205, that progressively separate from the slot 201 to form a tapering, —the dimensioning of a connection line 202 linked to a connection port 203, —the dimensioning of a transition connection line 202/slot 201 that ensures the energy transmission from the connection line 202 to the slot 201. To ensure a good energy coupling between the connection line 202 and the slot 201, it must be placed in specific geometrical conditions for the relative dispositions of the various elements mentioned. An example of such a positioning is given, for example, in the document U.S. Pat. No. 6,246,377.

The antenna 200 moreover presents a phase centre 206.

The main geometrical parameters of such an antenna 200 are the following:

- a length L, that defines the length of the tapered profile of the antenna,
- a maximum width X defining the maximum width of the tapered profile of the antenna, the maximum width is also called the antenna aperture,
- a length O, known as the overflow length, that defines the length of metallic conductor, for the right profile or for the left profile, present above the antenna aperture.

From these three geometrical parameters, it is possible to locate approximately the phase centre 206, notably from the following rule: the phase centre tends to the vertex, constituted for example of the end of the profile slot when X increases before L and inversely.

Finally it is possible to define, for any antenna of Vivaldi type, a bisector 207, the left profile 204 and the right profile 205 of the tapering defining a determined angle at the level of the start of tapering, the antenna bisector corresponding to the bisector of this angle.

FIG. 3 shows a radiation pattern 300 obtained from a radiating device 400 shown in FIG. 4. The radiating device 400 is constituted by the juxtaposition of four sectored antennas of Vivaldi type, referenced 401 to 404 arranged on a same plane substrate 405 in the following manner: the slots of each of the Vivaldi type antennas, respectively referenced 401, 402, 403 and 404 present a bisector corresponding to an axis of symmetry of left and right profiles of each antenna, respectively referenced 406, 407, 408 and 409, the bisectors 406 and 408 being combined, the bisectors 407 and 409 also being combined, and the bisectors 406 and 407 being perpendicular. The substrate 405 used presents a form that is globally square, with rounded angles at the extremities of the conductive parts associated with the considered antennas, each axis of symmetry mentioned constituting a median of one of the sides of the square forming the supporting substrate.

The radiating pattern 300 is an azimuthal radiating pattern, which is observed in a plane corresponding to the plane of the substrate 405. The radiating values are given according to an angle $\phi$ defined in the substrate plane, and having as origin the third bisector 408, according to the angle $\phi$ observed. The pattern 300 causes a ripple of the order of 20 dB, revealing a non omni-directional character of the radiating device 400. In a general way, for the purposes of simplification, the expression "omni-directional radiation" designates a radiation for which the strength, at least in a azimuthal state, is noticeably constant whatever the angle considered in the azimuthal plane.

In the invention, a solution for, from evolutions of the radiating device 400, obtaining an omni-directional radiating device is proposed. For this purpose, in the invention, it is proposed to control the network factor of different sectored antennas of the radiating device 400, the network factor being directly linked to the pattern form 300.

To define the radiating devices according to the invention, it has been shown that a preferential distance exists between the different antennas present on the substrate, and therefore between their phase centre.

FIG. 5 shows the different parameters intervening in the calculation of the azimuthal radiation pattern. On this figure are shown:

- d: distance between two phase centres of two consecutive Vivaldi type antennas,
- di: distance between the phase centre of a Vivaldi type antenna and the geometrical centre of Vivaldi type antenna network,
- $\phi$géo: angular deviation between two consecutive Vivaldi type antennas, given in degrees, the deviation is measured between the bisectors of two considered antennas,
- $\phi$: observation angle, given in degrees, in the azimuthal plane,
- $\theta$: observation angle, given in degrees, in a perpendicular plane to the azimuthal plane, when an observation point presents an angle $\theta$ of 90 degrees, said observation point is situated in the azimuthal plane,
- CPi: phase centre of the nth Vivaldi type antenna,
- M: Observation point.

The expression of the standardized electrical field associated with the radiating device 400 in the azimuthal plane, given by the relationship 1 below, is obtained in the following manner, relying on different parameters that are here enumerated, and that are visible on FIG. 6:

- $\vec{E}_{\theta,\phi}$: E field of the sectored antenna network,
- $\vec{E}_{i,\theta,\phi}$: E field of the nth sectored antenna,
- $\lambda$: Wavelength,
- $\phi_i$: Electrical phase difference applied to each sectored antenna,
- r: Distance between the centre of the sectored antenna network and the observation point,
- k: Propagation constant,
- $\alpha_i$: Angle between the observation direction and the direction given by the straight line linking the network centre to the centre of the considered phase.
- $f_{\theta=90°}(\phi)$: Radiation pattern of a sectored antenna.

Generally, the E field of the antenna network is written:

$$\vec{E}_{\theta,\phi} = \sum_i \vec{E}_{i,\theta,\phi}$$

To calculate the azimuthal radiation pattern, the E field in the plane θ=90° must be calculated in the following manner:

$$\vec{E}_{\theta=90°,\phi} = \sum_i^N f_{\theta=90°} \cdot e^{-jkr_i+\phi_i} \cdot \vec{E}_\phi \text{ with } N >= 3$$

where $$k = \frac{2\pi}{\lambda},\ r_i = r - d_i \cdot \cos(\alpha_i),\ d_i = \frac{p\lambda}{2 \cdot \sin(\pi/N)}$$

$$\vec{E}_{\theta=90°,\phi} = e^{-jkr} \sum_{i=1}^N f_{\theta=90°}(\phi - \phi_{géo} \cdot (i-1)) \cdot e^{-jkn_i+\phi_i} \cdot \vec{E}_\phi$$

where $$\phi_{géo} = \frac{360}{N}$$

$$n_i = d_i \cdot \cos(\phi_{géo} \cdot (i-1) - \phi)$$

From which $$\boxed{\vec{E}_{\theta=90°,\phi} = e^{-jkr} \cdot \sum_{i=1}^N f_{\theta=90°,i}(\phi - \phi_{géo} \cdot (i-1)) \cdot e^{jk \cdot d_i \cdot \cos(\phi_{géo} \cdot (i-1)-\phi)+\phi_i} \cdot \vec{E}_\phi}$$

The E plane copolarization then becomes:

$$\left\|\vec{E}_{\theta=90°}(\phi)\right\| = 20 \cdot \log\left[\mathrm{Re}^2\left(\vec{E}_{\theta=90°,\phi}\right) + \mathrm{Im}^2\left(\vec{E}_{\theta=90°,\phi}\right)\right] - \mathrm{Max}\left[20 \cdot \log\left[\mathrm{Re}^2\left(\vec{E}_{\theta=90°,\phi}\right) + \mathrm{Im}^2\left(\vec{E}_{\theta=90°,\phi}\right)\right]\right] \quad \text{(relationship 1)}$$

The position of the phase centre being directly linked to the profile of the tapered antenna, it has been proposed in the invention, to modify the profiles and the positions of the antennas arranged on a substrate with respect to the standard positioning shown in FIG. 3. The relationship 1 also enables showing that a preferential distance between the antennas exists enabling a radiation pattern noticeably omni-directional at least in the azimuthal plane to be obtained.

As a consequence, in the invention, a particular arrangement of Vivaldi type antennas on a substrate is proposed, an arrangement presenting a reduced distance between the antennas, while leaving a central zone, in the network of antennas thus constituted, of sufficient dimension to have a switching circuit for the various antennas. A diagrammatic representation of such an arrangement is given in FIG. 7.

On this figure, a network of Vivaldi type longitudinal radiation antennas 800, is constituted of a conducting material intended to be laid on a substrate, not represented, forming a ground plane. The antenna network is comprised of a first directive antenna 801, a second directive antenna 802, a third directive antenna 803, and a fourth directive antenna 804, that are arranged consecutively to form a network. A first antenna and a second antenna are called consecutive in the antenna network 800 when the left profile, respectively the right profile, of the tapering of the first antenna is extended by the right profile, respectively the left profile, of the second antenna.

In an antenna network, two opposed antennas can also be defined. A first antenna and a second antenna are called opposed in an antenna network when in the extension of the left profile of the first antenna, and as far as the right profile of the second antenna there are as many antenna tapering profiles as between the extension of the right profile of the first antenna as far as the left profile of the second antenna. Hence, in FIG. 7, it is said that the first antenna 801 and the third antenna 803 are opposed, as are the second antenna 802 and the fourth antenna 804. Each of the antennas 801, 802, 803 and 804 is characterized by a bisector, respectively referenced 801*b*, 802*b*, 803*b* and 804*b*.

The network antennas 800 have distances between each other that have been reduced with respect to a standard arrangement of the type represented in FIG. 3. For a distance between a first antenna and a second antenna, the measurement is defined between the vertex projections Si (i being a natural integer adopting as a value the number of the antenna with which it is associated) of profiles on the same line, the peak of the second antenna being extended perpendicularly on a reference line D, corresponding for example with the edge of the substrate at the level of which the aperture of the second antenna is measured, and the peak of the first antenna being extended perpendicularly on this same reference line.

With respect to the standard arrangement, the antenna vertex have each been brought closer to one of the support substrate edges, said edge being comprised here by the edge on which terminates the left profile of the considered antenna, two different vertex not being brought closer to the same edge, thus creating an asymmetry in the tapering profiles. The network 800 can thus be characterized by the fact that the bisectors of two opposed antennas are not combined. In the example shown, the bisectors of the two opposed antennas are parallel, thus preserving an antenna network symmetry, a symmetry that is beneficial to the omni-directional character of the radiation pattern. The bisectors of two opposed antennas respectively 802*b*, 804*b* and 803*b*, 801*b* are distant from one another and the bisectors of two consecutive antennas 802*b*-803*b*, 803*b*-804*b*, 804*b*-801*b*, and 801*b*-802*b*, are perpendicular with respect to one another.

An arrangement of antennas in an antenna network of the type shown in FIG. 7 enables a noticeably improved radiation pattern in azimuthal plane, with respect to the radiation pattern 300 in FIG. 3, to be obtained, the maximum amplitude difference in the observed radiations not exceeding 10 dB.

Advantageously, in the invention, in order to further improve the omni-directional radiation character of a longitudinal radiation antenna network, it is proposed to intervene at the level of the different geometrical characteristics of the considered antenna network.

A first geometrical characteristic at the level of which an intervention is advantageous resides in the form of the extremities of the tapering profiles. As can be seen in FIG. 7, these extremities are rendered square, the extremity of the left profile of a given antenna forming a right angle with the extremity of the right profile of the consecutive antenna, again enabling an improvement of the omni-directional character of radiation produced.

A second geometrical characteristic consists in changing the overflow component, also called offset, of each profile. An appropriate choice of the overflow component enables optimising the omni-directional character of the radiation pattern.

A third geometrical characteristic consists in changing in rotation each Vivaldi type antenna around an axis perpendicular to the substrate plane, situated, in the examples shown, at the extremity of a tapering profile, or the overflow extending the considered tapering. Asymmetry in the obtained tapering profiles is thus accentuated.

FIGS. 8 and 9 respectively show a top view and a view in perspective of an example of a radiating device according to the invention, in which the different parameters that have just been cited have been optimised.

In these figures, a second example 911 of the radiating device according to the invention is shown, in which are found the four Vivaldi type longitudinal radiation antennas, referenced 901, 902, 903 and 904, constituting the network 910 arranged on a substrate 912. Each of the four antennas is linked to a connection line, referenced respectively 905, 906, 907 and 908, intended to provoke the excitation of the antenna with which it is in contact at the level of its vertex referenced respectively S11, S22, S33 and S44. Each of the antennas has a bisector referenced respectively 901*b*, 902*b*, 903*b* and 904*b*. The connection lines used are for example lines of microstrip line type. All of these connection lines are connected to a switching circuit 909, that enables selection of one, several or all antennas present in the antenna network. In the case shown in FIG. 8, the bisectors of opposed antennas are noticeably parallel with one another and not combined and the bisectors of consecutive antennas are perpendicular with respect to one another.

Besides the antenna vertex positions, the radiating device 911 differs from the radiating device of FIG. 7 in that a rotation of each Vivaldi type antenna 901, 902, 903, 904 is carried out around an axis 913*a*, 913*b*, 913*c*, 913*d* respectively perpendicular to the substrate plane, situated at the extremity of each of the tapering profiles, or of the overflow extending the tapering considered at the 4 corners of the antenna such as the point 913 for the antenna 902. This rotation maintains the above conditions concerning the antenna bisectors.

In FIG. 8, different geometrical characteristics of each Vivaldi type antenna were identified:

a profile length L, a width X of the tapered profile before the overflows, a first overflow length O1, associated with a first tapered profile of the antenna, a second overflow length O2, associated with a second tapered profile of the antenna, an angle of rotation Alpha of the antenna, a total width C of the tapered profile, An embodiment of the device according to the invention resides in the adoption of the following value ranges for these geometrical characteristics, given notably according to the operating wavelength LO of the considered antennas:

0.25LO<L<2.5LO 0.25LO<x<2.5LO 0.6LO<O1<1.5LO

0<O2<0.25LO 0 degree<Alpha<20 degrees

LO<C<2.5LO.

A particular embodiment resides in the adoption of the following values, for an operating wavelength LO:

L=0.7LO

X=LO

O1=0.75LO

O2=0.04LO

Alpha=5 degrees

C=1.8LO.

Thus, with an operating frequency of 5 GHz (gigahertz), the following different geometrical parameters are obtained:

L=37.5 mm

X=55 mm

O1=39.5 mm

O2=2.1 mm

Alpha=5 degrees

C=96.7 mm.

Such an embodiment enables, when the four antennas are activated, a radiation pattern 914 in an azimuthal plane, shown in FIG. 10, to be obtained. The omni-directional character is observed, a difference in amplitude of only 5 dB maximum being observed, whichever two observation points are taken in the substrate plane 901.

In FIG. 11, is shown a perfected embodiment of the radiating device 915 according to the invention.

In this perfected example, the radiating device according to the invention presents, in addition to the first set of antennas 901, 902, 903 and 904, a second set of Vivaldi type antennas, that have been added to the second embodiment of the radiating device 911 previously described. The addition of the second set of antennas consists in profiting from the dissymmetric character of the tapering of antenna of the device 911 to modify the longest profile of each antenna tapering, realising there a slot associated with a tapered profile forming a longitudinal radiation antenna of Vivaldi antenna type. As shown in FIG. 11, an antenna 916 housed in the right profile of the first antenna 901 is thus obtained.

Advantageously, the antennas of the first set of antennas are dimensioned to operate at a frequency f (for example 2.4 GHz), the antennas of the second set of antennas being dimensioned to operate at a higher frequency, in the neighbourhood of 2 f, that is in the neighbourhood of 5 GHz. Hence a very compact system of multi-sector antennas operating in 2 frequency bands is obtained, the two Wi-Fi bands, 2.4 GHz and 5 GHz in the example provided. The use of two frequency bands enables, in a general way, to increase the global capacity of the meshed network in which will be used the devices equipped with such radiating devices.

Advantageously, the dimensioning of different antennas is such that the wireless characteristics are similar for the two operating frequency bands. For this purpose, it is provided, in this embodiment of the invention, that if the multi-sector antenna system comprising the radiating device 915 occupies a square surface of side a, the antennas of the second set of antennas are realised so that they occupy a square surface equivalent to side a/2. Thus, the two antenna sets, that have scale ratios in the same proportions as the frequency ratios, present equivalent wireless characteristics, and notably radiation characteristics.

Advantageously, as shown in FIG. 11, with the purpose of minimising the coupling between the two intervening frequencies, there are different antennas available so that the main direction of the radiation of an antenna of the first set of antennas and the main direction of an antenna of the second set of antennas present an angle in the neighbourhood of 45 degrees.

Advantageously, in order to limit the manufacturing costs of such a dual frequency band compact multi-sector radiating device, it is proposed to use a stack of several FR4 type substrate layers. In an embodiment variation, two distinct metallized layers are used for the implementation of the radiating elements: a first layer for the first set of antennas at 2.4 GHZ and a second layer for the second set of antennas at 5 GHz. A non coplanarity of the two sets of antennas are thus obtained that enable the interactions between the two frequencies used to be further minimised.

The invention claimed is:

1. Planar multi-sector radiating device intended to receive and/or transmit electromagnetic signals, comprising at least, arranged on a plane substrate covered by a conductive material:

a first set of antennas, with:

a first antenna, a second antenna, a third antenna, arranged on the plane substrate in the opposite manner to the first antenna, a fourth antenna, arranged on the plane substrate in the opposite manner to the second antenna, said antennas each presenting a bisector, wherein the bisector of opposing first and third, and second and forth, antennas are distant from and parallel to one another, and the bisectors of any two consecutively arranged antennas are perpendicular with respect to each other;

each of said antennas being tapering slot antennas, a tapering originating at a vertex and presenting a left profile and a right profile, wherein the left profile and the right profile of each antenna is dissymmetric with respect to the bisector of that same antenna and which bisector passes through the respective vertex, the radiating device comprising a switching circuit capable of activating one or more of the antennas.

2. Radiating device according to claim 1, wherein the left profile of one of the antennas of the first set of antennas presents at the level of antenna aperture, one extremity forming a right angle with the right profile of the antenna consecutive to the considered antenna.

3. Radiating device according to claim 1, wherein the switching circuit is at the level of a central part of the antenna network, the switching circuit being linked to the slot of each of the antennas by means of a connection line.

4. Radiating device according to claim 1, each antenna of the antenna network presenting the following characteristics:

an operating wavelength LO, a profile length L, a width X of the tapered profile before the overflows, a first overflow length O1, associated with a first tapered profile of the antenna, a second overflow length O2, associated with a second tapered profile of the antenna, an angle of rotation Alpha of the antenna, a total width C of the tapered profile, wherein, each antenna presents the following dimensioning:

$0.25LO<L<2.5LO$ $0.25LO<X<2.5LO$ $0.6LO<O1<1.5LO$ $0<O2<0.25LO$ 0 degree<Alpha<20 degrees $LO<C<2.5LO$.

5. Radiating device according to claim 4, wherein each antenna presents the following dimensioning:

$L=0.7LO$ $X=LO$ $O1=0.75LO$ $O2=0.04LO$

Alpha=5 degrees $C=1.8LO$.

6. Radiating device according to claim 1, comprising a second set of longitudinal radiation antennas of tapered slot antenna type, the second set of antennas comprising additional antennas, the slot of each of the additional antennas being set at profile level with a greater dimension than one of the antennas of the first set of antennas.

7. Radiating device according claim 6, wherein the operating frequency of the second set of antennas is different from the operating frequency of the first set of antennas.

* * * * *